US011388951B2

(12) United States Patent
Rhenter

(10) Patent No.: US 11,388,951 B2
(45) Date of Patent: Jul. 19, 2022

(54) SOLE FOR AN ITEM OF FOOTWEAR HAVING PROGRESSIVE DAMPING

(71) Applicant: Jean-Luc Rhenter, Arzier (CH)

(72) Inventor: Jean-Luc Rhenter, Arzier (CH)

( * ) Notice: Subject to any disclaimer, the term of this patent is extended or adjusted under 35 U.S.C. 154(b) by 141 days.

(21) Appl. No.: 16/650,028

(22) PCT Filed: Oct. 5, 2018

(86) PCT No.: PCT/IB2018/057744
§ 371 (c)(1),
(2) Date: Mar. 24, 2020

(87) PCT Pub. No.: WO2019/069277
PCT Pub. Date: Apr. 11, 2019

(65) Prior Publication Data

US 2020/0275738 A1 Sep. 3, 2020

(30) Foreign Application Priority Data

Oct. 5, 2017 (FR) ..... 1759350

(51) Int. Cl.

| | |
|---|---|
| ***A43B 13/18*** | (2006.01) |
| ***A43B 13/38*** | (2006.01) |
| ***A43B 7/14*** | (2022.01) |
| ***A43B 13/12*** | (2006.01) |
| ***A43B 7/1425*** | (2022.01) |
| ***A43B 7/1435*** | (2022.01) |
| ***A43B 7/144*** | (2022.01) |
| ***A43B 7/1445*** | (2022.01) |

(Continued)

(52) U.S. Cl.
CPC ..... *A43B 13/188* (2013.01); *A43B 7/144* (2013.01); *A43B 7/145* (2013.01); *A43B 7/1425* (2013.01); *A43B 7/1435* (2013.01); *A43B 7/1445* (2013.01); *A43B 7/1475* (2013.01); *A43B 13/12* (2013.01); *A43B 13/383* (2013.01)

(58) Field of Classification Search
CPC ..... A43B 13/188
See application file for complete search history.

(56) References Cited

U.S. PATENT DOCUMENTS 4,551,930 A * 11/1985 Graham ..... A43B 5/06 36/114
5,014,706 A * 5/1991 Philipp ..... A43B 7/141 36/140

(Continued)

FOREIGN PATENT DOCUMENTS

DE 2709546 A1 9/1978

*Primary Examiner* — Jila M Mohandesi
(74) *Attorney, Agent, or Firm* — William H. Eilberg

(57) ABSTRACT

A damping sole includes support zones with a main surface that have a relative stiffness or hardness lower than that of the other zones, the support zones being positioned under the load-bearing protuberances of the foot. The support zones are delimited by oblique lateral faces that are inclined towards the lower main surface of the sole at an inclination angle (A) and are disposed such that, at rest, they come to bear obliquely against the peripheral surface of the dermal part of the corresponding load-bearing protuberance of the foot. In this way, a compromise is reached between the need for impact damping and the need for foot stability in a shoe, while ensuring satisfactory comfort.

12 Claims, 4 Drawing Sheets

(51) Int. Cl.
*A43B 7/145* (2022.01)
*A43B 7/1475* (2022.01)

(56) References Cited

U.S. PATENT DOCUMENTS

| | | | | |
|---|---|---|---|---|
| 7,526,882 | B2 * | 5/2009 | Rhenter | A43B 7/1445 36/174 |
| 8,166,674 | B2 * | 5/2012 | Dananberg | A43B 7/226 36/43 |
| 2001/0039746 | A1 * | 11/2001 | Seiter | A43B 7/1445 36/44 |
| 2003/0061738 | A1 * | 4/2003 | Grohninger | A43B 17/035 36/89 |
| 2006/0185197 | A1 | 8/2006 | Rhenter | |
| 2013/0185955 | A1 * | 7/2013 | Cheng | A43B 7/1485 36/28 |

* cited by examiner

SOLE FOR AN ITEM OF FOOTWEAR HAVING PROGRESSIVE DAMPING

TECHNICAL FIELD OF THE INVENTION

The present invention concerns damping soles for use in an item of footwear between an outer sole of the item of footwear, intended to come into contact with the ground, and the plantar surface of a user's foot engaged in the item of footwear.

Removable inner soles are frequently used, generally limited by an upper main surface adapted to be in contact with the plantar surface of the foot, by a lower surface adapted to be in contact with the item of footwear sole, and by a peripheral contour conformed to engage in the interior contour of the item of footwear.

Removable inner soles generally have the object of compensation of size or of shape, for a better fit of the item of footwear to the foot of the user. The thickness of the removable inner sole is chosen accordingly, and this thickness may vary as a function of the zones concerned under the foot of the user.

There has already been described in document WO 2005/013746 A1 a removable inner sole intended to be integrated into an item of footwear to provide effective damping of impacts on the foot when used for walking or running, and simultaneously to procure some stability of the foot in the shoe by opposing movements of the foot relative to the shoe when walking or running and lateral or rotation movements when changing direction.

There is also known, from the document DE 27 09 546 A1, a sole having a continuous support zone of less stiff material and two zones of material of greater stiffness. The support zone occupies the heel zone, the cuboid zone, the zone of the fourth and fifth metatarsal heads, and the zone of the great toe. A first zone of greater stiffness surrounds at least roughly the zone of the heel. A second zone of greater stiffness forms a support for the second to fifth toes. The effect of this sole is to raise the plantar surface of the foot and to favor the rolling movement of the foot when walking. The interior edges of the zones of greater stiffness are inclined so that the continuous support zone partly covers the zone of greater stiffness, to avoid the presence of sharp edges liable to cause pain.

Until now, however, with a removable inner sole of this kind, either the stability of the foot in the item of footwear is insufficient when walking rapidly, running or jumping, or the stability of the foot in the item of footwear is achieved at the cost of unacceptable discomfort, which the inventor of the present invention attributes to shockwaves that propagate to the spinal column of the user and induce spinal problems.

Moreover, intermediate soles have already been developed, fixed into the shoe between the outer sole and the insole or an inner sole, and structured to damp vertical forces. However, these intermediate soles do not achieve stability of the foot and do not solve the problem of shockwaves in the spine of the user when walking rapidly, running or jumping.

SUMMARY OF THE INVENTION

The problem addressed by the present invention is to design a sole intended to be integrated into an item of footwear, which achieves good positioning and good stability of the foot in the shoe to prevent unwanted movements of the foot relative to the shoe, and which simultaneously achieves a significant reduction of the shockwave that propagates as far as the spinal column of the user when walking fast, running or jumping and lateral or rotation movements when changing direction.

To achieve these and other objects, the invention proposes a damping sole able to be disposed in an item of footwear between an outer sole of the item of footwear and the plantar surface of a foot engaged in the item of footwear and having load-bearing protuberances with a dermal part limited by a peripheral edge, the damping sole being limited by a sole upper main surface, by a sole lower main surface adapted to be oriented toward the outer sole of the item of footwear, and by a peripheral contour conformed to project beyond the plantar surface of the foot and to follow the interior contour of the item of footwear, the damping sole having main surface zones having at least two respective different stiffnesses or hardnesses, in which:

- the damping sole includes sole support zones each disposed so as to come under a respective load-bearing protuberance of the foot and sole braking zones,
- said sole braking zones surround said sole support zones and include in particular a continuous strip between the support zones and the sole peripheral contour,
- the sole support zones are based on a first material, while the sole braking zones are based on a second material,
- the first material has a relative hardness or stiffness lower than that of the second material,
- the sole support zones are limited by respective lateral faces of the braking zones forming a boundary between the first material and the second material,
- the relative hardness or stiffness of said first material is between 15 and 35 Shore A inclusive, the relative hardness or stiffness of said second material is between 20 and 40 Shore A inclusive, with a difference between said relative hardnesses or stiffnesses of at least approximately 5 Shore A and at most approximately 15 Shore A,
- said respective lateral faces of the braking zones are inclined toward the sole upper main surface, forming a generally conical braking zone surface surrounding at least one of the sole support zones coming under a corresponding load-bearing protuberance of the foot,
- the respective lateral faces are arranged so that, when the foot is statically supported on the sole, all or most of the sections of the respective lateral faces come in line with the peripheral edge of the dermal part of said respective load-bearing protuberance of the foot, so that said respective load-bearing protuberance of the foot is engaged along the peripheral edge of its dermal part in said at least one of the sole support zones, and comes to bear along its perimeter against the generally conical surface formed by the lateral faces of the sole braking zones surrounding said at least one sole support zone.

Because the first and second materials have relative hardnesses or stiffnesses expressed on the Shore A scale, these are elastically deformable materials that resume their initial shape at rest after being loaded in compression.

The chosen relative hardness or stiffness values of the first and second materials in themselves eliminate all risk of pain in the foot of the user engaged on the damping sole, whatever the position and the orientation of the lateral faces of the braking zones.

Moreover, by the combination of the specific locations and shapes of the sole support zones, and the oblique orientation of the lateral face of the sole braking zones, coming at rest in line with the peripheral edge of the dermal part of the corresponding load-bearing protuberance of the foot, the problem on which the invention is based is solved effectively, namely simultaneously achieving stability of the foot and significant reduction of the shockwave.

In fact, if the oblique lateral face of a sole braking zone were placed not so as to come at rest in line with the peripheral edge of the dermal part of the corresponding load-bearing protuberance of the foot, but to be at a distance from the load-bearing protuberance of the foot, this would result in a loss of peripheral bracing and guidance of the foot opposing lateral and antero-posterior movements of the foot relative to the shoe, and a loss of the effect of progressive antero-posterior and lateral damping that reduces the shockwaves.

Similarly, if the oblique lateral face of a sole braking zone were placed not so as to come at rest in line with the peripheral edge of the dermal part of the corresponding load-bearing protuberance of the foot, but so as to be under the load-bearing protuberance of the foot, this would result in a severe loss of peripheral bracing and guidance of the foot opposing lateral and antero-posterior movements of the foot relative to the shoe.

Moreover, if the lateral zone of a sole braking zone were not oblique but perpendicular to the upper main surface of the sole, whilst being correctly placed to come at rest in line with the peripheral edge of the dermal part of the corresponding load-bearing protuberance of the foot, this would result in sudden exaggerated blocking of lateral and antero-posterior movements of the foot relative to the shoe, generating shockwaves propagating as far as the spinal column of the user.

The generation of the shockwaves is linked to an increase in the pressure at the periphery of the support zone. By way of example, for a 76 kg adult, the pressures at the periphery of the sole support zones have been measured by taking for example the heads of the first and second metatarsals during rapid walking. When the lateral face of the sole braking zones is perpendicular to the sole upper main surface, the pressures are greater than or equal to 4500 g per square centimeter. Clearly, during rapid walking, running or jumping movements or changes of direction, these high transient pressures generate shockwaves. On the other hand, when the lateral face of the sole braking zones is oblique, at an angle of inclination of approximately 45°, the pressures are less than or equal to 2500 g per square centimeter, and a small horizontal movement of the foot is then allowed whilst being braked progressively, which very significantly reduces the corresponding shockwaves.

It is therefore clear that, in accordance with the invention, effective and progressive bracing is achieved so as to prevent the occurrence of shockwaves liable to propagate as far as the spinal column of the user.

In practise, the angle of inclination between said lateral faces of the sole braking zones and the sole upper main surface may be between 15° and 60° inclusive. Good results can be obtained when the angle of inclination between said lateral faces and the sole upper main surface is approximately 45'.

The effects of peripheral bracing and damping also depend on the thickness of the damping sole, in combination with the relative hardness or stiffness values of the first and second materials. To this end it is preferable for the deformation of the damping sole to be compatible with the pressure forces exerted by the foot of the user during fast walking and running or jumping with changes of direction, i.e. this deformation remains incomplete when maximum pressure forces are exerted by the foot. Given that, during rapid walking and running with the heel leading, the maximum pressure forces are higher in the heel zone of the foot than in the interior zone, it is advantageous for the thickness of the damping sole to vary along its length, with a greater thickness in the posterior zone and a lesser thickness in the anterior zone of the damping sole.

As a function of the precision looked for in the damping and bracing effects, it is possible to distinguish in a human foot a greater or lesser number of load-bearing protuberances, each defined by a bony protuberance covered by a dermal envelope, and thus to define a greater or lesser number of sole support zones in a damping sole in accordance with the invention.

However, in accordance with the invention, satisfactory effects can be obtained by a simplification consisting in considering, in the human foot, an anterior load-bearing protuberance of the foot formed by the phalanges of the foot and a main load-bearing protuberance of the foot formed by the metatarsal heads of the foot, by the antero-external part of the calcaneus, by the cuboid, by the fifth metatarsal of the foot, and by the heel of the foot. Under these conditions, a damping sole in accordance with the invention may advantageously be provided comprising:

- a first material sole anterior support zone, conformed and disposed so as, in use of the sole, to come under an anterior load-bearing protuberance of the foot formed by the phalanges of the foot,
- a first material sole main support zone, conformed and disposed so as, in use of the sole, to come under a main load-bearing protuberance of the foot, and including a distal support part disposed so as to come under the metatarsal heads of the foot, an external support part disposed so as to come under the fifth metatarsal of the foot, under the cuboid and under the antero-external part of the calcaneus, and a posterior support part disposed so as to come under the heel of the foot,
- the anterior support zone being separated from the assembly formed by the main support zone by a second material intermediate transverse braking zone.

This optimizes the bracing effect produced by the lateral face of the sole braking zones surrounding the support zones.

In a first application, the damping sole may constitute an intermediate sole fixed into the item of footwear between the outer sole and the insole or may constitute an inner sole.

In a second application, the damping sole may constitute a removable inner sole the upper main surface of which is adapted to be in contact in the plantar surface of the foot, the lower main surface of which is adapted to be in contact with an inner sole of the item of footwear, and the peripheral contour of which is conformed to be engaged in the interior contour of the item of footwear.

In this case, good peripheral bracing of the foot of the user relative to an item of footwear necessitates that the removable inner sole be itself well braced, longitudinally and laterally, in the item of footwear when it is disposed in the item of footwear between an inner sole of the item of footwear and the plantar surface of the foot. For good immobilization of the removable inner sole, the upper main surface of the removable inner sole may advantageously be generally plane, and the removable inner sole advantageously includes along its perimeter a peripheral facet generally inclined toward the lower main surface of the sole. In practise, the peripheral facet may advantageously be inclined with a mean inclination of 20 to 70°.

Considering that the first and second materials necessarily have some porosity to have a satisfactory elastic deformation capacity, said porosity leading to a possibility of penetration of microbial agents into the interior of said first and second materials, for reasons of hygiene it is recommended that the removable inner sole has a cleanliness coating on its upper main face.

In practise, in all the applications envisaged, the damping sole according to the invention may be constituted of an assembly glued together or otherwise fastened together of a first elastomer material constituting the sole support zones and a second elastomer material constituting the sole braking zones, with a glued on cleanliness upper coating.

In accordance with another aspect, the invention proposes an item of footwear including at least one damping sole as defined hereinabove. In practise, an item of footwear of this kind may include a fixed damping intermediate sole of this kind, a removable damping inner sole of this kind, or both a fixed damping intermediate sole of this kind and a removable damping inner sole of this kind.

In accordance with another aspect, the present invention proposes the use of a damping sole disposed in an item of footwear between an outer sole of the item of footwear and the plantar surface of a foot engaged in the item of footwear and having load-bearing protuberances with a dermal part limited by a peripheral edge, the damping sole being limited by a sole upper main surface, by a sole lower main surface adapted to be oriented toward the outer sole of the item of footwear, and by a peripheral contour conformed to project beyond the plantar surface of the foot and to follow the interior contour of the item of footwear, the damping sole having main surface zones having at least two respective different stiffnesses or hardnesses, in which:

- the damping sole includes sole support zones each disposed so as to come under a respective load-bearing protuberance of the foot and sole braking zones,
- said sole braking zones surround said sole support zones and include in particular a continuous strip between the support zones and the sole peripheral contour,
- the sole support zones are based on a first material, while the sole braking zones are based on a second material,
- the first material has a relative hardness or stiffness less than that of the second material,
- the sole support zones are limited by respective lateral faces of the sole braking zones forming a boundary between the first material and the second material,
- the relative hardness or stiffness of said first material is between 15 and 35 Shore A inclusive, the relative hardness or stiffness of said second material is between 20 and 40 Shore A inclusive, with a difference between said relative stiffnesses or hardnesses of at least approximately 5 Shore A and at most approximately 15 Shore A,
- said respective lateral faces of the braking zones are inclined toward the sole upper main surface, forming a generally conical braking zone surface surrounding at least one of the sole support zones,
- the respective lateral faces are arranged so that, when the foot is statically support on the sole, all or most of the sections of the respective lateral faces come in line with the peripheral edge of the dermal part of said respective load-bearing protuberance of the foot, so that said respective load-bearing protuberance of the foot is engaged along the peripheral edge of its dermal part in said at least one of the sole support zones, and comes to bear along its perimeter against the generally conical surface formed by the lateral faces of the sole braking zones surrounding said at least one sole support zone.

BRIEF DESCRIPTION OF THE DRAWINGS

Other objects, features and advantages of the present invention will emerge from the following description of particular embodiments given with reference to the appended figures, in which.

DESCRIPTION OF THE PREFERRED EMBODIMENTS

In the embodiment shown in the figures, a removable inner sole according to the invention is limited by an upper main surface 1, a lower main surface 2, and a peripheral contour 3.

The lower main surface 2 is adapted to be in contact with an item of footwear inner sole. In the embodiment shown it may be adapted to suit an item of footwear the bearing surface of which is plane or corrugated in the longitudinal direction to follow the usual general anatomical curvature of the foot and the support surface of which is generally plane or concave in the transverse direction. The peripheral contour 3 is conformed to be engaged in the interior contour of the item of footwear, and to this end has as seen from above the usual curvatures of the peripheral contours of known removable inner soles.

At rest, the upper main surface 1 has a usual plane general shape for removable inner soles, but this shape may vary without departing from the scope of the present invention, in particular to adapt to the arch of the user.

Figure 4:
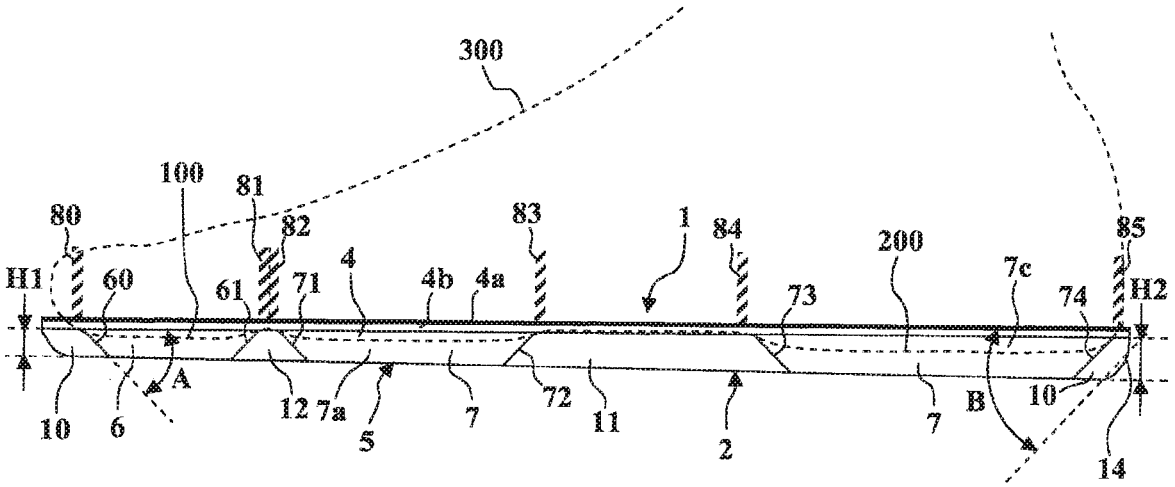
FIG. 4 is a side view in longitudinal section of the sole from FIG. 2, as seen on the longitudinal section plane II-II.

In the embodiment shown in FIG. 4 the thickness of the removable inner sole varies slightly along a longitudinal plane II-II (FIG. 2), and also varies as a function of the transverse position of the longitudinal plane in question. This thickness is larger (H2) in the posterior zone situated under the heel of the foot and smaller (H1) in the anterior end zones. In this case an enhanced damping effect is obtained in the posterior zone.

Figure 2:
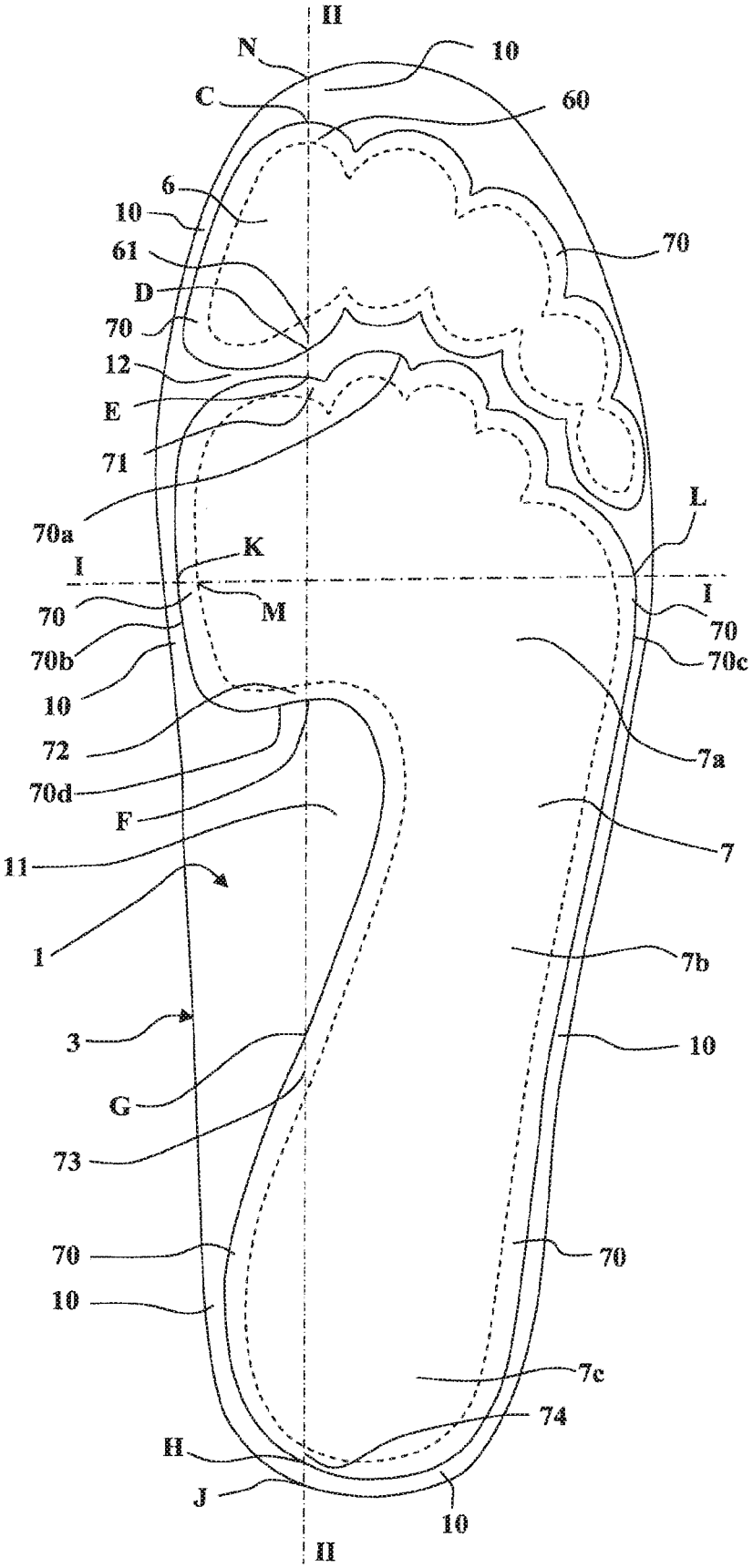
FIG. 2 is a view from above of the sole upper main surface according to the embodiment from FIG. 1, with the cleanliness coating removed, showing simultaneously the arrangement of the sole support zones and the sole braking zones.

In a practical embodiment shown in the figures, concerning a removable inner sole of European size 43, there is considered in FIG. 2 the longitudinal plane II-II of the sole, perpendicular to the general plane of the sole and passing the sole zone intended to be located under the gap between the first and second toes. In the side view in longitudinal section shown in FIG. 4, that is to say on the plane II-II shown in FIG. 2, the thickness H1 at the anterior end of a sport removable inner sole may be of the order of 4 to 9 mm, whereas its posterior end thickness H2 may be of the order of 5 to 11 mm, the thickness of the removable inner sole varying, for example continuously, or at least with no sudden discontinuity, along its length between the reduced thickness H1 at the anterior end and the increased thickness H2 at the posterior end.

For a town removable inner sole, slightly smaller thicknesses may be chosen, for example a thickness H1 of 3 to 6 mm at the anterior end and a thickness H2 of 4 to 8 mm at the posterior end.

The thicknesses are given by way of illustrative example and are liable to vary as a function in particular of the damping to be achieved and the shoes to be fitted. Thus increased thicknesses could be chosen to increase the damping properties, or vice versa.

Figure 1:
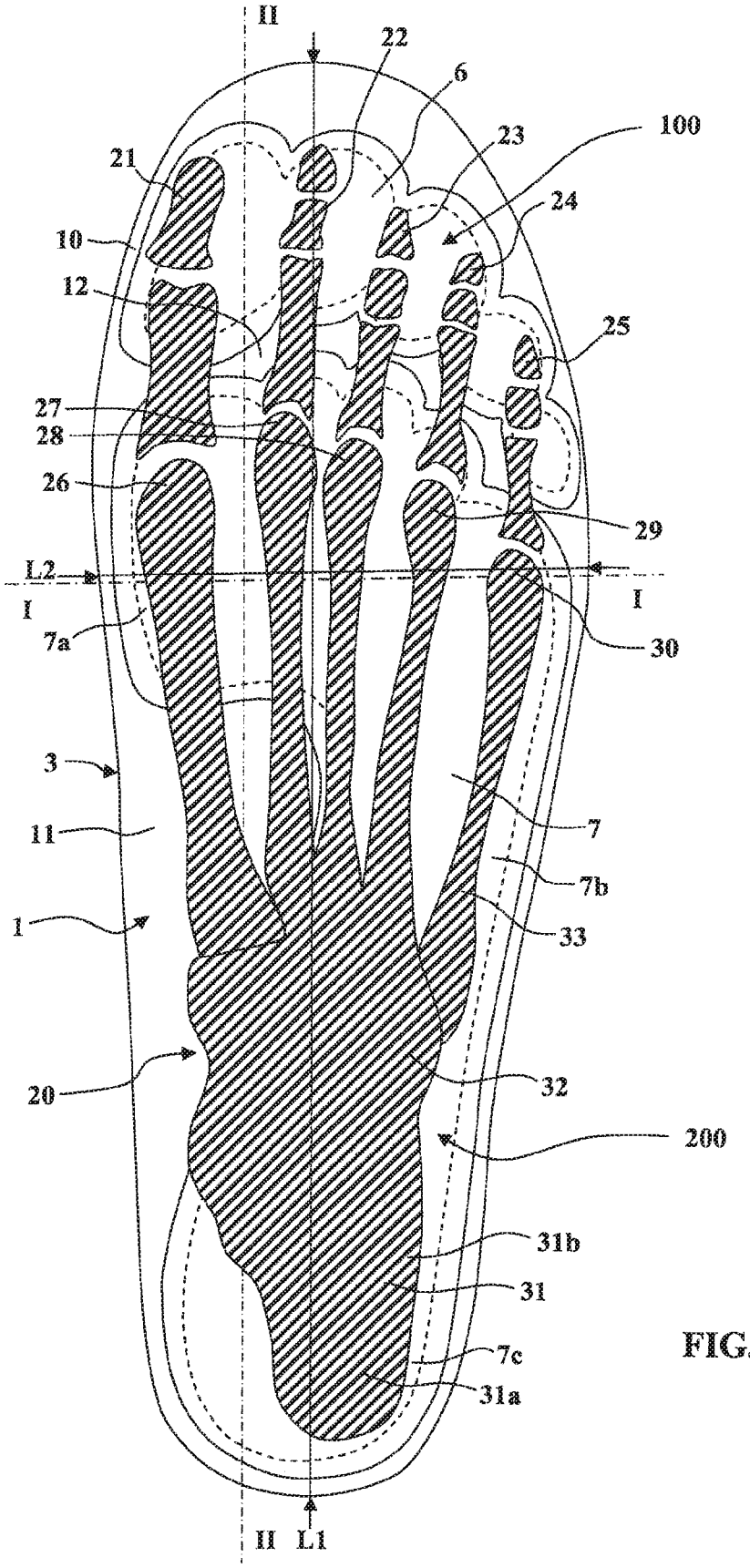
FIG. 1 shows in a view from above a right foot removable inner sole in accordance with one embodiment of the present invention, with superimposed thereon skeletal parts of the foot constituting the load-bearing protuberances of the foot.

As shown in FIG. 1, the length L1 of the removable inner sole of European size 43 is 30 cm. Its width varies as a function of the transverse plane concerned: the maximum width L2 in the transverse plane I-I is approximately 10 cm, reducing progressively toward the front and toward the rear.

In the embodiment shown in FIGS. 1 to 4, the removable inner sole includes a base structure 5 to which is fixed a cleanliness coating 4. The cleanliness coating 4 may for example be an Alcantara fabric 0.5 to 1 mm thick for a sport removable inner sole, or a thickness of leather of 0.5 to 0.8 mm for a town removable inner sole. According to another example, a cleanliness coating 4 may be provided consisting of the superposition of an upper film 4*b* itself preferably covered with a comfort fabric 4*a* constituting the upper surface 1 and adapted to contact with the skin of the foot. The upper film 4*b* may advantageously be made of an anti-bacterial material. There may therefore be chosen for the base structure 5 a different material, suitable for the effects looked for, and compatibility of which with contact with the foot is not required.

The removable inner sole of the invention is intended to cooperate with the foot 300 (FIGS. 3, 4) in a particular manner, to procure the functions of effective damping of impacts on the foot 300, stability of the foot 300 in the shoe, and reduced shockwaves during movements of rapid walking, running, rotation, jumping or changing direction.

To this end, the removable inner sole essentially cooperates with the load-bearing protuberances of the foot, the skeleton of which is shown in FIG. 1.

In this FIG. 1 the horizontal projection of the skeleton 20 of the foot has been represented in a view from above. There are seen the phalanges 21, 22, 23, 24 and 25, the metatarsal heads 26, 27, 28, 29 and 30, the calcaneus 31, which includes a posterior part 31*a* constituting the heel and an antero-external part 31*b*, an external part of the cuboid 32, and finally the fifth metatarsal 33.

The phalanges 21-25, covered by their respective dermal parts that are not shown in this figure, constitute an anterior load-bearing protuberance 100 of the foot. A main load-bearing protuberance 200 of the foot is formed by the metatarsal heads 26-30, the fifth metatarsal 33, the cuboid 32, the antero-external part 31*b* of the calcaneus 31, and the posterior part 31*a* of the calcaneus 31, or heel, each of these skeletal elements being covered by its respective dermal part.

The anterior load-bearing protuberance 100 of the foot is limited by an anterior peripheral edge defined by the external peripheral edges of the dermal parts of the phalanges 21-25. Likewise, the main load-bearing protuberance 200 of the foot is limited by a main peripheral edge defined by the external peripheral edges of the dermal parts of the skeletal elements 26-33 forming said load-bearing protuberance 200.

Considering simultaneously FIGS. 1 and 2, it is seen, on the upper main surface 1, that the removable inner sole according to the invention comprises distinct zones, and these zones have distinct mechanical properties.

Thus the removable inner sole according to the invention includes, in this embodiment, sole support zones based on a first material and sole braking zones based on a second material.

The sole support zones comprise an anterior sole support zone 6, intended to come under the anterior load-bearing protuberance 100 constituted by the phalanges 21-25 of the foot of the user, and a sole main support zone 7, intended to come under the main load-bearing protuberance 200 of the foot, and including a distal support part 7*a* disposed so as to come under the metatarsal heads 26, 27, 28, 29 and 30 of the foot, an external support part 7*b* disposed so as to come under the fifth metatarsal 33, under the cuboid 32 and under the antero-external part 31*b* of the calcaneus 31, and a posterior support part 7*c* disposed so as to come under the heel of the foot or posterior part 31*a* of the calcaneus 31.

The sole braking zones occupy all of the sole surface that is not occupied by the sole support zones 6 and 7 and are constituted of a second material. Seen in particular, in these braking zones, are a peripheral border 10, that constitutes all of the periphery of the removable inner sole, a plantar zone 11, and an intermediate transverse zone 12 that separates the anterior sole support zone 6 from the main sole support zone 7.

Each of the sole support zones 6 and 7 is limited by a continuous contour, constituted by a respective braking zone lateral face forming a boundary between the first material constituting the sole support zone 6 or 7 and the sole braking zones 10, 11 or 12 that surround the sole support zones 6 and 7 that are constituted of said second material.

Figure 3:
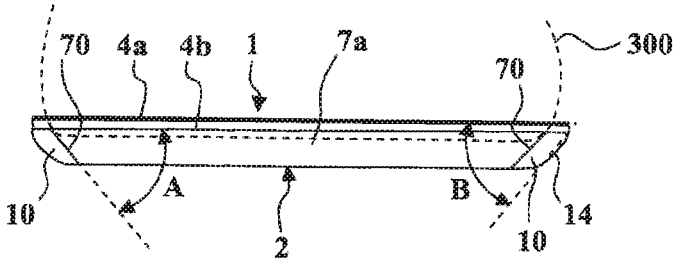
FIG. 3 is a view from the rear in cross section of the sole from FIG. 2, as seen on the transverse section plane I-I.

Said respective lateral faces are seen in FIGS. 3 and 4.

Thus, in FIG. 3, the distal support part 7*a* of the sole main support zone 7 is limited, on the left and on the right, by the lateral face 70 of the braking zone peripheral border 10.

According to the invention, said lateral face 70, oriented toward the center of the sole, is inclined toward the sole upper main surface 1 at an angle of inclination A. In the figures, the angle of inclination A is constant and approximately 45°. In practise, good results could be obtained by providing an angle of inclination A between 15° and 60° inclusive.

In FIG. 4, in the section on the longitudinal plane II-II, the sole anterior support zone 6 is bordered at the front and at the rear, in a similar manner, by the respective posterior lateral face 60 and anterior lateral face 61 of the braking zones 10 and 12, oriented toward the center of the anterior support zone and also inclined toward the sole upper main surface 1 at the same angle of inclination A. The sole anterior bearing zone 6 is also bordered, on the left and on the right, by the lateral face 70 of the braking zone peripheral border 10, in a similar manner to what is shown in FIG. 3 for the sole main support zone 7. Likewise, the distal support part 7*a* is bordered at the front by the posterior lateral face 71 of the intermediate braking zone 12 and at the rear by the anterior lateral face 72 of the braking plantar zone 11, while the posterior support part 7*c* of the sole main support zone 7 is bordered at the front by the posterior lateral face 73 of the braking plantar zone 11 and at the rear by the anterior lateral face 74 of the braking zone peripheral border 10, with the orientations and inclinations shown in FIG. 4.

Because of the orientation and the inclination of the lateral faces 60, 61, 70, 71, 72, 73 and 74, in the FIG. 2 view from above, the horizontal dimension of the corresponding sole support zone 6 or 7 is greater in the vicinity of the sole upper main surface 1 than in the vicinity of the sole lower main surface 2. Thus, in FIGS. 1 and 2, there are shown in solid line the contour of each of the sole support zones 6 and 7 in the vicinity of the sole upper main surface 1 and in dashed line the contour of the same sole support zones 6 and 7 in the vicinity of the sole lower main surface 2.

Considering more specifically FIG. 4, there has been shown the relative position of the sole support zones 6 and 7 and the load-bearing protuberances 100 and 200 of the foot 300, when the removable inner sole according to the invention is used in an item of footwear between the plantar surface of the foot 300 and an inner sole of the item of footwear. In the case of static support, that is to say when the user is immobile in a standing position, supported on the removable inner sole, the anterior load-bearing protuberance 100 of the foot 300 bears on the sole anterior support zone 6, while the main load-bearing protuberance 200 of the foot 300 is supported on the sole main support zone 7. In this static position, at least some sections of the lateral faces 60, 61 (FIG. 4) and 70 (FIG. 3) of the sole braking zones 10, 12 come in line with the peripheral edge of the anterior load-bearing protuberance 100 of the foot. In other words, the anterior load-bearing protuberance 100 of the foot 300 is engaged, along the peripheral edge of its dermal part, in the sole anterior support zone 6, and comes to be supported along its perimeter against the generally conical surface formed by the inclined lateral faces 60, 61 and 70 of the sole braking zones 10 and 12 that surround the sole anterior support zone 6. Likewise, at least some sections of the sole braking zone lateral faces 70, 71, 72, 73, 74 come in line with the peripheral edge of the main load-bearing protuberance 200 of the foot 300. In other words, the main load-bearing protuberance 200 of the foot 300 is engaged, along the peripheral edge of its dermal part, in the sole main support zone 7, and comes to be supported along its perimeter against the generally conical surface formed by the inclined lateral faces 70, 71, 72, 73, 74 of the sole braking zones 10, 11, 12 that surround the posterior support zone 7.

Let us remember that the load-bearing protuberances 100, 200 of the foot 300 are formed of an interior bony part covered by a dermal layer. During dynamic movements, lateral and/or antero-posterior forces are applied by the foot to the removable inner sole and the foot 300 tends to be moved horizontally, toward one side or the other or toward the front or the rear, as a function of the forces. These movements are however progressively braked and limited by the damping effect of the removable inner sole according to the invention, with the result that only the dermal parts of the load-bearing protuberances 100 and 200 of the foot 300 are able to emerge slightly from the corresponding sole support zone 6 or 7. Shown shaded in FIG. 4 are the possible antero-posterior movements 80, 81, 82, 83, 84 and 85 of the dermal zones of the load-bearing protuberances 100 and 200 of the foot 300, and the maximum value of the movements can be of the order of 10 to 12 mm.

As a result, during dynamic movements, the bony parts of the load-bearing protuberances 100 and 200 of the foot 300 remain permanently in line with the corresponding sole support zones 6 or 7.

To obtain this effect, the first and second elastically deformable materials are chosen with different relative hardnesses or stiffnesses, the first material having a relative hardness or stiffness less than that of the second material. In practise, the relative hardness or stiffness of the first material may be between approximately 15 and 35 Shore A inclusive, while the relative hardness or stiffness of the second material may be between approximately 20 and 40 Shore A inclusive, advantageously with a relative hardness or stiffness difference of at least approximately 5 Shore A and at most approximately 15 Shore A.

On vertical pressure of the foot 300 on the removable inner sole, the sole support zones of lower relative hardness or stiffness, in this instance the sole anterior support zone 6 and the sole main support zone 7 in the embodiment shown, receive the respective load-bearing protuberances 100 and 200 of the foot 300, and are therefore subjected to the greatest mechanical forces from the foot 300. They are elastically deformed by the action of the vertical pressure of the foot. Thanks to the fact that their relative hardness or stiffness is lower, the deformation under load of the sole anterior support zones 6 and sole main support zones 7 increases, favoring a certain localized pressing in of the foot 300 in these zones. During static bearing of the foot on the sole, the result of this is then that the load-bearing protuberances 100 and 200 of the foot 300 are engaged in the corresponding support zones 6 and 7 and their perimeter comes to bear against the generally conical surfaces formed by the oblique lateral faces 60, 61, 70, 71, 72, 73 and 74 of the braking zones 10, 12 and 11 of the sole.

On horizontal pressure of the foot 300 on the removable inner sole, for example on a change of direction of the user, thanks to the fact that the lateral faces 60, 61, 70, 71, 72, 73 and 74 are oriented toward the center of the sole and inclined toward the upper main surface 1 of the sole at the angle of inclination A, and thanks to the fact that said lateral faces are arranged so that most of their sections distributed along the periphery come in line with the dermal part peripheral edge of the corresponding load-bearing protuberance 100, 200 of the foot 300, the sole braking zones 10, 11 and 12 of greater relative hardness or stiffness that surround the sole support zones 6 and 7 progressively brake the horizontal movements of the foot 300 relative to the removable inner sole, which produces progressive peripheral damping, an effect of stability of the foot 300 in the shoe, and a significant reduction of the shockwaves liable to propagate into the spine of the user.

In practise, the support zones 6 and 7 of lower relative hardness or stiffness may be determined with curvilinear contours as shown in FIGS. 1 and 2. In this instance the anterior support zone 6 is constituted of the combination of five oval zones as shown, each corresponding to one of the phalanges 21-25 covered by their respective dermal part. Likewise, the distal part 7*a* of the main support zone 7 is limited by an anterior edge 70*a* with five arches each corresponding to one of the metatarsal heads 26-30 of the foot covered by their respective dermal part, by two longitudinal lateral edges 70*b* and 70*c*, and by a transverse posterior edge 70*d* occupying slightly less than the interior half-width of the removable inner sole. The posterior support part 7*c* of the main support zone 7 is of oval or circular shape, matching the shape of the heel of the foot of the user. The external support part 7*b* of the main support zone 7 has a width that reduces progressively from its connection to the posterior support part 7*c* as far as its connection to the distal part 7*a*.

By way of example, for a removable inner sole of European size 43, contour dispositions may be chosen as shown in FIG. 2, with dimensions that can be defined by the following distances between the noteworthy points indicated in the figure: NC=2.2 cm, CD=3.1 cm, DE=1.8 cm, EF=5.4 cm, FG=10.5 cm, GH=6.0 cm, HJ=1.4 cm, KL=9.3 cm, KM=3 to 5 mm.

Figure 5:
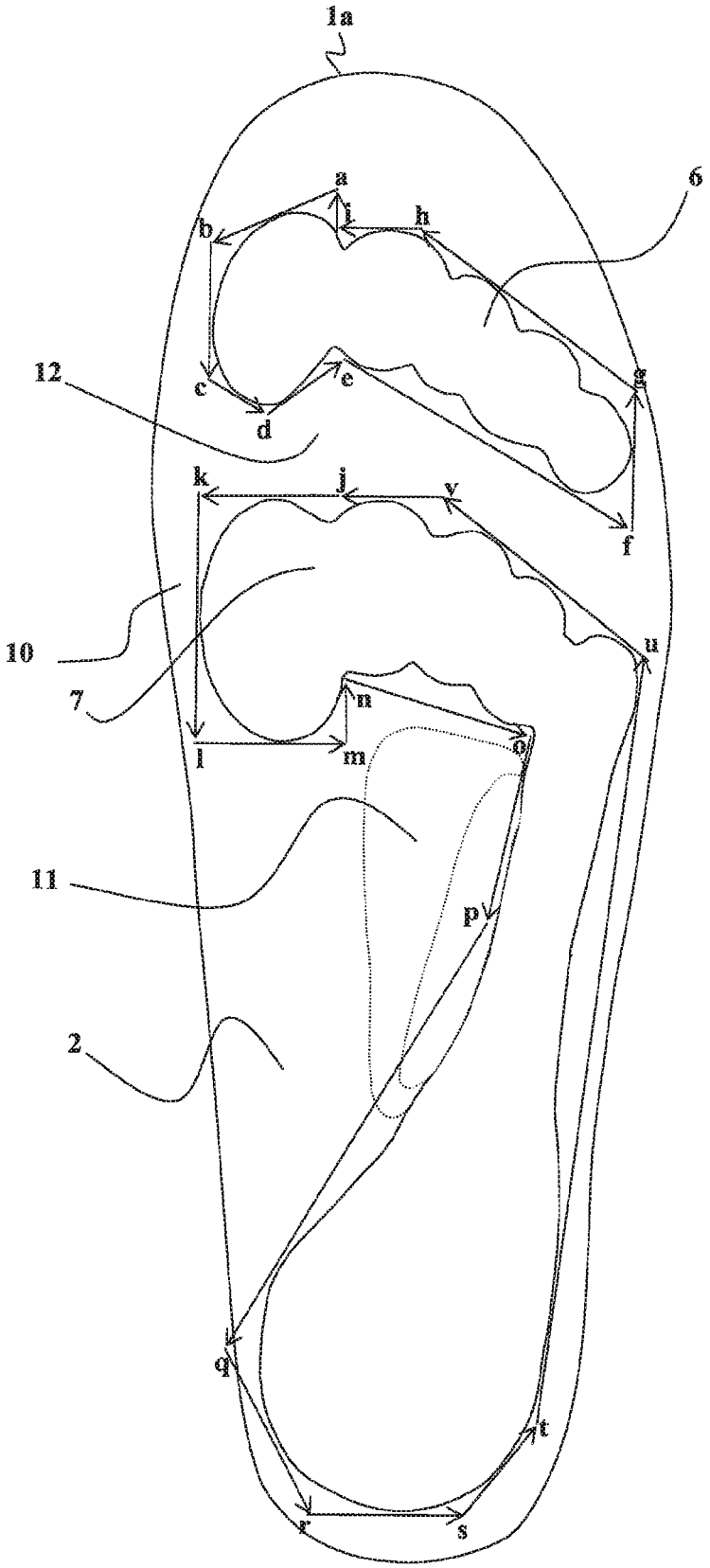
FIG. 5 shows the contour of the support zones on the lower face of a sole according to another embodiment of the invention.

To give another example, in another embodiment shown in FIG. 5, for a size 42 damping sole, along the lower surface 2 of the sole:

the anterior support zone 6 is circumscribed in a polygon defined by the vectors ab (2.6 cm, 240°), bc (2.6 cm, 180°), cd (0.9 cm, 120°), de (1.9 cm, 50°), ef (6.3 cm, 120°), fg (2.5 cm, 0°), gh (5 cm, 310°), hi (1.6 cm, 270°), ia (0.8 cm, 0°);

the assembly forming the main support zone 7 is circumscribed in a polygon defined by the vectors: jk (2.2 cm, 270°), kl (4.6 cm, 180°), lm (2.2 cm, 90°), mn (1.1 cm, 0°), no (3.7 cm, 105°), op (4.8 cm, 195°), pq (7.7 cm, 215°), qr (3.7 cm, 160°), rs (3.2 cm, 90°), st (1.8 cm, 35°), tu (14.8 cm, 10°), uv (4.3 cm, 305°), vj (1.7 cm, 270°).

As is usual in the items of footwear industry, the other sizes are determined homothetically.

The cleanliness coating 4 is sufficiently thin and flexible not to affect the effectiveness of the base structure 5 with different relative hardness zones.

To ensure good stability of the removable inner sole itself in the item of footwear, the sole upper main surface 1 may advantageously be generally plane and the removable inner sole may include at its perimeter 3 a peripheral facet 14 generally inclined toward the sole lower main surface 2, at a mean inclination B of 20 to 70°.

One embodiment consists in providing a sole entirely made of a second elastomer material of hardness equal to the higher relative hardness or stiffness, cutting out the zones provided to constitute the sole support zones, sticking into the zones cut out in this way sheets of a first elastomer material of lower relative hardness or stiffness, and then sticking on the cleanliness coating 4.

There may be used, as materials constituting the sole body, closed cell foam elastomers of appropriate density to produce the relative hardnesses or stiffnesses looked for. Good results have been obtained using, as second material forming the braking zones 10, 11 and 12, an ethyl vinyl acetate (EVA) foam, while the first material forming the support zones 6, 7 is formed of a polyurethane foam.

In the embodiment described above with reference to the figures, the damping sole is a removable inner sole.

In accordance with another embodiment of the invention, the damping sole constitutes an intermediate sole, fixed in the item of footwear between the outer sole and the insole or an inner sole of the item of footwear.

In this case, the structure of the damping sole is also as shown in FIGS. 1 to 4, the only difference residing in the intermediate position of the damping sole in the shoe, and possibly in its thickness possibly being greater than in the case of a removable inner sole.

In practise, there could be imagined an item of footwear incorporating a fixed intermediate sole as described hereinabove or an item of footwear incorporating a removable inner sole as described above, or even an item of footwear incorporating both a fixed intermediate sole of this kind and a removable inner sole of this kind, combining their respective foot stabilization effects.

The present invention is not limited to the embodiments that have been described explicitly, including the various variants and generalizations thereof contained within the scope of the following claims.

The invention claimed is:

1. A damping sole for an item of footwear able to be disposed in an item of footwear between an outer sole of the item of footwear and the plantar surface of a foot engaged in the item of footwear and having load-bearing protuberances with a dermal part limited by a peripheral edge, the damping sole being limited by a sole upper main surface, by a sole lower main surface adapted to be oriented toward the outer sole of the item of footwear, and by a peripheral contour conformed to project beyond the plantar surface of the foot and to follow the interior contour of the item of footwear, the damping sole having main surface zones having at least two respective different stiffnesses or hardnesses, in which:

the damping sole includes sole support zones each disposed so as to come under a respective load-bearing protuberance of the foot and sole braking zones, said sole braking zones surround said sole support zones and include in particular a continuous strip between the support zones and the sole peripheral contour, the sole support zones are based on a first material, while the sole braking zones are based on a second material, the first material has a relative hardness or stiffness lower than that of the second material, the sole support zones are limited by respective lateral faces of the braking zones forming a boundary between the first material and the second material, wherein:

the relative hardness or stiffness of said first material is between 15 and 35 Shore A inclusive, the relative hardness or stiffness of said second material is between 20 and 40 Shore A inclusive, with a difference between said relative stiffnesses or hardnesses of at least approximately 5 Shore A and at most approximately 15 Shore A, said respective lateral faces of the braking zones are inclined toward the sole upper main surface, wherein said lateral faces are oblique, and non-perpendicular, to the upper main surface of the sole, said lateral faces forming a generally conical braking zone surface surrounding at least one of the sole support zones coming under a corresponding load-bearing protuberance of the foot, wherein said inclined lateral faces are located inside the sole, the respective lateral faces are arranged so that, when the foot is statically supported on the sole, all or most of the sections of the respective lateral faces come in line with the peripheral edge of the dermal part of said respective load-bearing protuberance of the foot, so that said respective load-bearing protuberance of the foot is engaged along the peripheral edge of its dermal part in said at least one of the sole support zones, and comes to bear along its perimeter against the generally conical surface formed by the lateral faces of the sole braking zones surrounding said at least one sole support zone.

2. The damping sole as claimed in claim 1, wherein said lateral faces of the sole braking zones and the sole upper main surface form between them an angle (A) of inclination between 15° and 60° inclusive.

3. The damping sole as claimed in claim 2, wherein said angle (A) of inclination is approximately 45°.

4. The damping sole according to claim 1, wherein the thickness of the damping sole varies along its length, with a greater thickness (H2) in a posterior zone and a lesser thickness (H1) in an anterior zone of the damping sole.

5. The damping sole according to claim 1, comprising:

a first material sole anterior support zone, conformed and disposed so as, in use of the sole, to come under an anterior load-bearing protuberance of the foot formed by the phalanges of the foot, a first material sole main support zone, conformed and disposed so as, in use of the sole, to come under a main load-bearing protuberance of the foot, and including a distal support part disposed so as to come under the metatarsal heads of the foot, an external support part disposed so as to come under the fifth metatarsal of the foot, under the cuboid and under the antero-external part of the calcaneus, and a posterior support part disposed so as to come under the heel of the foot, the anterior support zone being separated from the assembly formed by the main support zone by a second material intermediate transverse braking zone.

6. The damping sole according to claim 1, constituting an intermediate sole fixed into the item of footwear between the outer sole and the insole or an inner sole.

7. The damping sole according to claim 1, constituting a removable inner sole the upper main surface of which is adapted to be in contact in the plantar surface of the foot, the lower main surface of which is adapted to be in contact with an inner sole of the item of footwear, and the peripheral contour of which is conformed to be engaged in the interior contour of the item of footwear.

8. The damping sole as claimed in claim 7, wherein the sole upper main surface is generally plane, and in that the damping sole includes along its peripheral contour a peripheral facet generally inclined toward the lower main surface of the sole, at a mean inclination (B) of 20 to 70°.

9. The damping sole according to claim 7, including on its upper main face a cleanliness coating.

10. The damping sole according to claim 1, wherein it is constituted of a glued together assembly of a first elastomer material constituting the sole support zones and a second elastomer material constituting the sole braking zones, with a glued on cleanliness upper coating.

11. An item of footwear including at least one damping sole according to claim 1.

12. Use of a damping sole disposed in an item of footwear between an outer sole of the item of footwear and the plantar surface of a foot engaged in the item of footwear and having load-bearing protuberances with a dermal part limited by a peripheral edge, the damping sole being limited by a sole upper main surface, by a sole lower main surface adapted to be oriented toward the outer sole of the item of footwear, and by a peripheral contour conformed to project beyond the plantar surface of the foot and to follow the interior contour of the item of footwear, the damping sole having main surface zones having at least two respective different stiffnesses or hardnesses, in which:

the damping sole includes sole support zones each disposed so as to come under a respective load-bearing protuberance of the foot and sole braking zones, said sole braking zones surround said sole support zones and include in particular a continuous strip between the support zones and the sole peripheral contour, the sole support zones are based on a first material, while the sole braking zones are based on a second material, the first material has a relative hardness or stiffness less than that of the second material, the sole support zones are limited by respective lateral faces of the sole braking zones forming a boundary between the first material and the second material, wherein said lateral faces are oblique, and non-perpendicular, to the upper main surface of the sole, said lateral faces being located inside the sole, the relative hardness or stiffness of said first material is between 15 and 35 Shore A inclusive, the relative hardness or stiffness of said second material is between 20 and 40 Shore A inclusive, with a difference between said relative hardnesses or stiffnesses of at least approximately 5 Shore A and at most approximately 15 Shore A, said respective lateral faces of the braking zones are inclined toward the sole upper main surface, forming a generally conical braking zone surface surrounding at least one of the sole support zones, the respective lateral faces are arranged so that, when the foot is statically supported on the sole, all or most of the sections of the respective lateral faces come in line with the peripheral edge of the dermal part of said respective load-bearing protuberance of the foot, so that said respective load-bearing protuberance of the foot is engaged along the peripheral edge of its dermal part in said at least one of the sole support zones, and comes to bear along its perimeter against the generally conical surface formed by the lateral faces of the sole braking zones surrounding said at least one sole support zone.

* * * * *